United States Patent [19]
Charlton
[11] 4,317,617
[45] Mar. 2, 1982

[54] TRAFFIC CHANNELING DEVICE

[75] Inventor: Marshall J. Charlton, Monroe, La.

[73] Assignee: Manville Service Corporation, Denver, Colo.

[21] Appl. No.: 180,237

[22] Filed: Aug. 22, 1980

[51] Int. Cl.[3] ..... G02B 5/12
[52] U.S. Cl. ..... 350/97; 116/63 P
[58] Field of Search ..... 350/97-100; 229/31 R, 31 F, 31 S, 32, 33, 34 R, 34 A, 34 B, 41 C; 116/63 P

[56] References Cited

U.S. PATENT DOCUMENTS

| | | | |
|---|---|---|---|
| 3,964,668 | 6/1976 | Lin | 229/31 R |
| 3,977,594 | 8/1976 | Swan | 229/41 C |
| 4,065,047 | 9/1976 | Swan | 229/41 C |
| 4,119,265 | 10/1978 | Dlugopolski | 229/31 R |
| 4,157,210 | 6/1979 | Mesman | 350/97 |

*Primary Examiner*—R. A. Rosenberger
*Attorney, Agent, or Firm*—Robert M. Krone; Joseph J. Kelly; Norvell E. Von Behren

[57] ABSTRACT

An improved traffic channeling device for positioning on a highway in a normal traffic flow pattern. The improved device comprises a generally paperboard shell structure which has formed on its lower portion an inwardly folded flap structure. An inner cap like structure is positioned within the device and is positioned in contact with the lower inner periphery of the shell and the inwardly folded flap structure to act as a means to aid in the forming of the device in its predetermined shape. The inner cap like structure serves also as the means to support an object positioned over the flap structure to hold the shell structure in a predetermined position on the highway. The outside of the shell structure contains warning means for warning the traffic flow that the device has been positioned on the highway with the warning means comprising in the preferred embodiment an adhesive reflecting tape being applied to at least a portion of the outside of the shell structure.

10 Claims, 17 Drawing Figures

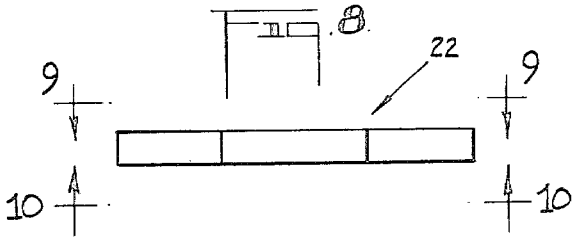
8
22
9
9
10
10
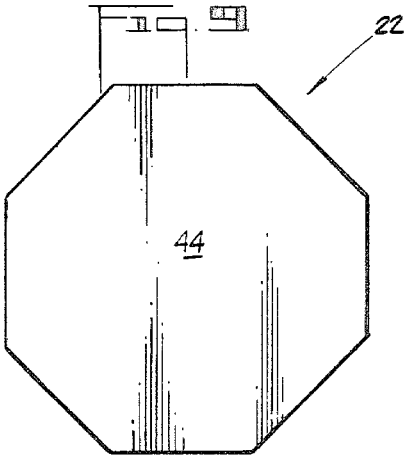
9
22
44
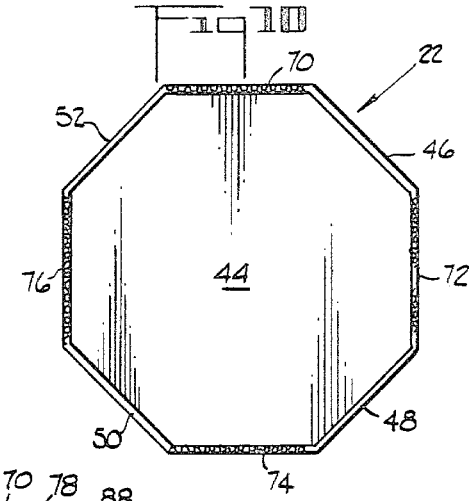
10
70
22
52
46
76
44
72
50
48
74
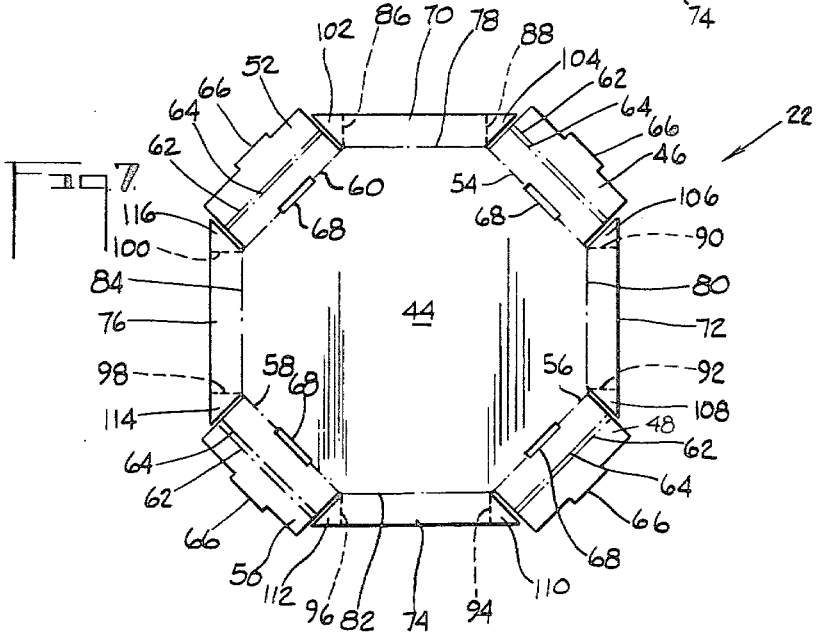
7
102
86
70
78
88
104
62
64
66
52
22
46
60
54
68
68
106
116
100
90
84
80
76
44
72
98
58
68
56
92
114
108
48
62
64
64
62
66
66
56
112
96
82
74
94
110
68

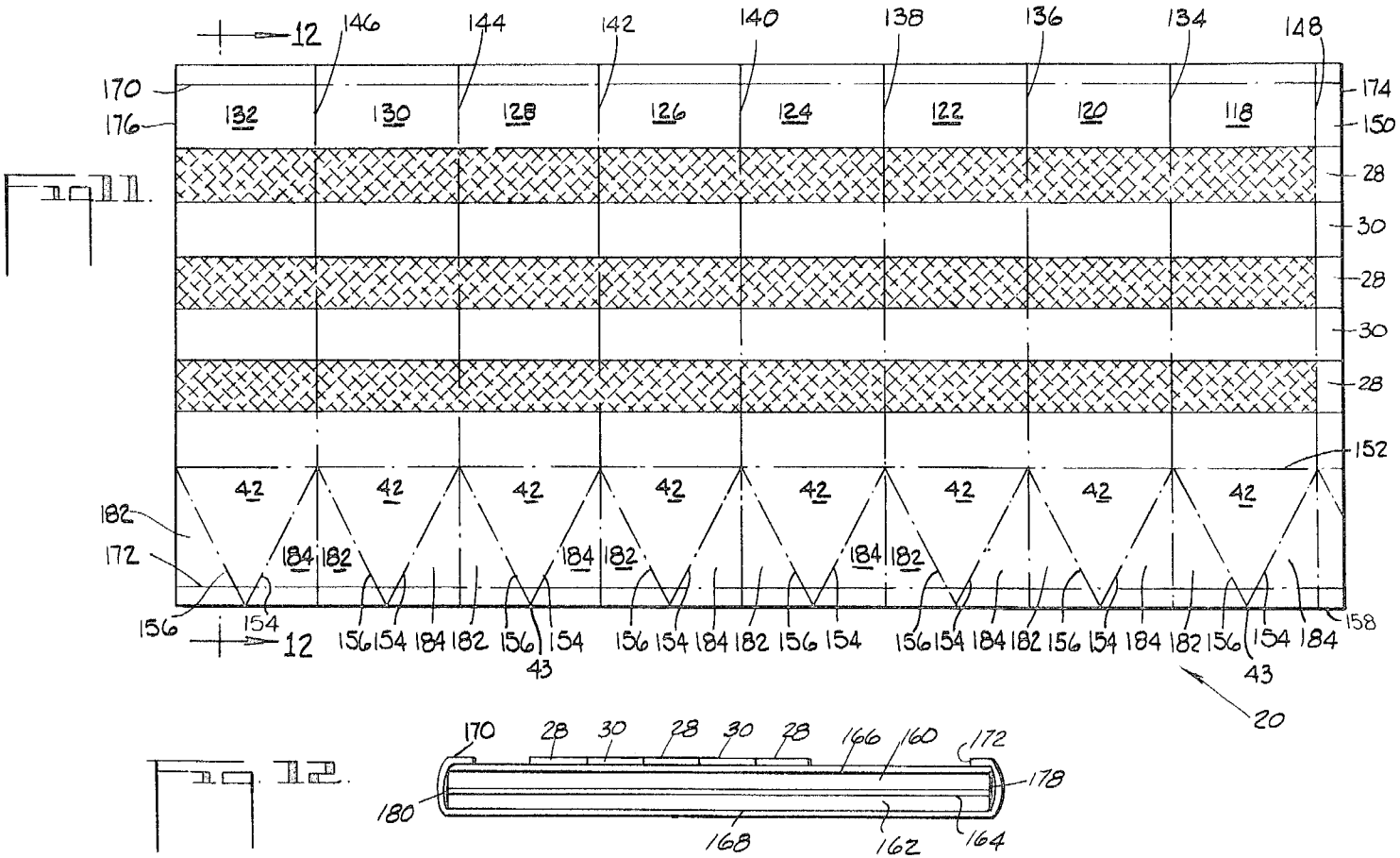
174
150
28
30
28
30
28
152
158
148
118
134
120
136
122
138
124
140
126
142
128
144
130
146
132
12
12
42
43
20
154
156
182
184
170
176
172
178
164
160
162
166
168
180

TRAFFIC CHANNELING DEVICE

BACKGROUND OF THE INVENTION

This invention relates generally to highway traffic channeling devices and more particularly to an improved highway traffic channeling device made out of a paperboard shell utilized in combination with warning means and means aiding in the forming of the shell to insure a predetermined shape as well as an upright position of the shell structure on the highway.

Traffic channeling devices are utilized by highway departments in the area of construction in progress and serve the function of channeling the normal traffic which must pass by the construction site generally to one lane or to a different lane so that the construction can continue without interrupting traffic flow. The traffic channeling devices normally take the form of steel barrels or plastic barrels and may also take the form of horses or barracades having sides attached thereto indicating that the traffic is to move to another lane. It is also known to use at times stacked automobile tires which are held in position by some sort of center post.

The U.S. Pat. No. 4,157,210 issued June 5, 1979 to James W. Mesman discloses a corrugated traffic channeling device for vertical positioning in a flow of traffic. A patent application Ser. No. 126,582 filed Mar. 3, 1980 is directed to an improvement of the Mesman patent which utilizes a flat sheet positioned over inturned flaps as a support base for a weight to hold the channeling device to the ground. This application is an improvement over the beforementioned application Ser. No. 126,582 and utilizes a novel inner cap like structure to replace the beforementioned flat sheet.

SUMMARY OF THE INVENTION

There has been provided by the subject invention a new and novel improved traffic channeling device which comprises a paperboard shell structure which may be quickly set up at the job site with the use of a tightly fitting inner cap like structure positioned within the shell structure and located at the bottom thereof. The inner cap like structure allows the shell to retain its predetermined shape and adds stability to the shell by provided a means to more evenly distribute weight on the shell flap structure. The outer shell structure also contains warning means for warning the traffic flow that the device has been positioned on the highway in the normal traffic flow.

In the preferred embodiment, the paperboard shell structure has formed thereon on one end thereof an inwardly folded triangular shaped flap structure with the shell structure being designed for standing on the highway in a vertical position with the open end upward so that a flat horizontal portion of the inwardly folded triangular shaped flat structure is in contact with the highway surface. An inner tight fitting cap like structure is positioned inside the shell structure in contact therewith around the lower inner periphery of the shell structure and is also in contact with the inwardly folded flap structure. The inner cap aids in forming the shell to its predetermined shape and helps the shell to retain that shape. The inner cap like structure also acts as a table upon which an internally positioned weight is positioned. An internal weight may then be used to hold the shell on the highway by forcing downwardly on the table and to the folded flap structure. The inner cap like structure evenly distributes the weight to the bottom of the shell around the periphery thereof to firmly fix the shell in position on the highway.

In the preferred embodiment, the paperboard shell structure as well as the inner cap like structure is made in an octagonal cross sectional configuration. The warning means on the outside of the structure may comprise in the preferred embodiment an adhesive reflecting tape being applied to a portion or all of the outside of the shell of the structure and may also comprise a reflective coating such as a beadlike coating being applied to all or a portion of the outside of the shell.

An object and advantage of the invention is to provide a traffic channeling device which contains an inner cap like structure which aids in forming the device into a predetermined shape and to further add stability to the device by acting as a table upon which a weight may be placed, the inner cap like structure serving to evenly distribute the weight around the periphery of the shell.

This and other objects and advantages of the invention will become apparent from a review of the drawing and from a reading of the description of the preferred embodiment, as well as a study of the claims of the subject invention.

BRIEF DESCRIPTION OF THE DRAWINGS

FIG. 7 is a plan view of a production blank for the outer top cap which may be utilized with the preferred embodiment;

FIG. 8 is a side view of the top cap shown in FIG. 7 showing the outer top cap assembled;

FIG. 9 is a top view, taken along line 9—9 of FIG. 8, showing the top of the assembled outer top cap;

FIG. 10 is a bottom view, taken along line 10—10 of FIG. 8, showing the bottom of an assembled top cap;

FIG. 11 is a plan view of the production blank for the improved paperboard shell showing the placement of the warning means reflector tape of the preferred embodiment and further showing the flap structure;

FIG. 12 is a cross sectional view, taken along line 12—12 of FIG. 11 showing the formation of rolled edges on both ends of the paperboard shell;

DESCRIPTION OF THE PREFERRED EMBODIMENT

Figure 1:
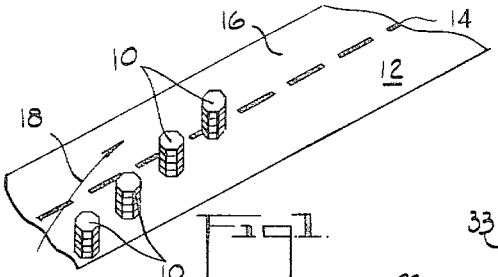
FIG. 1 is a perspective view showing several traffic channeling devices positioned as normally utilized on a highway.

Referring now to the drawings in general and in particular to FIG. 1 of the drawing, there is shown a plurality of traffic channeling devices 10 shown positioned in the right hand traffic lane 12 of the highway 14. The purpose of utilizing the traffic channeling devices 10 is to divert the flow of traffic from the right hand lane 12 to the left hand land 16 in the direction shown by the arrow 18 in order that some desired construction may be completed in the right hand lane 12 without interrupting flow of traffic on the highway 14.

Turning now to FIGS. 2-6 of the drawings, there is shown the improved traffic channeling device of the Applicants' invention which may comprise in the preferred embodiment an octagonal shaped paperboard shell structure shown generally by the numeral 20. The shell structure may have placed on top thereof an outer octagonal top cap shown generally by the numeral 22. The shell structure 20 is formed out of corrugated paperboard in the preferred embodiment and may be formed with a manufacturers joint 24 having a plurality of staples 26 applied thereto as is well known in the art.

The outer surface of the paperboard shell 20 may be coated to make it moisture proof with such materials as wax or other water-proofing materials and would have applied thereto warning means for warning the traffic flow that the device has been positioned on the highway in the normal traffic flow. The warning means in the preferred embodiment shown in FIG. 2 would take the form of a plurality of adhesive reflecting tape strips 28 which may be colored orange and a plurality of adhesive reflecting tape strips 30 which may be colored white. The warning means may also comprise a reflective coating being applied in a desired manner to at least a portion of the outside of the shell 12 as desired by the purchaser of the traffic channeling device.

Figure 2:
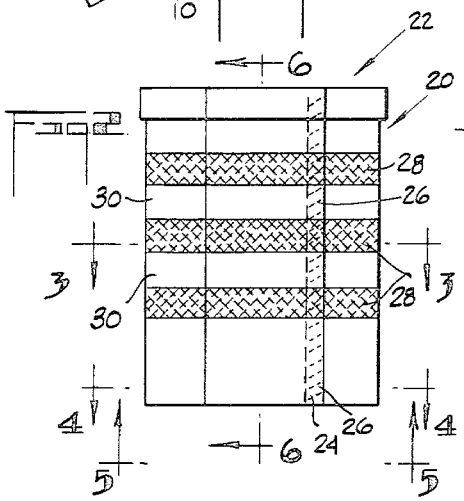
FIG. 2 is a side view showing a preferred embodiment of the subject invention having an outer top cap positioned on top thereof.
Figure 4:
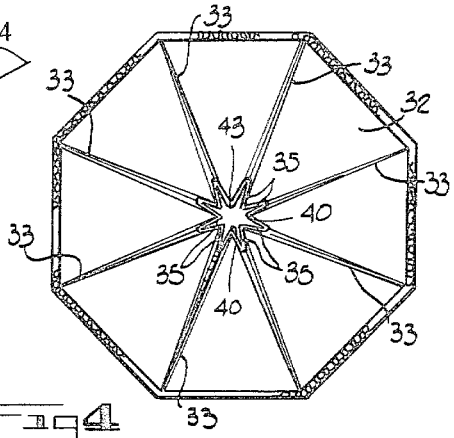
FIG. 4 is a cross sectional view, taken along line 4—4 of FIG. 2 showing the remaining portion of the inwardly folded improved flap structure of the improved device.
Figure 3:
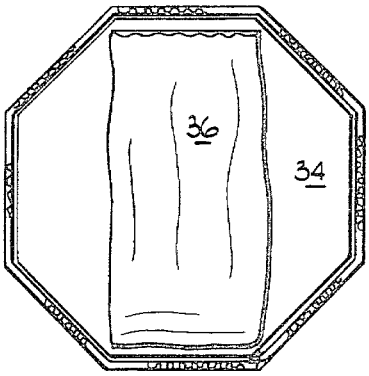
FIG. 3 is a cross sectional view, taken along line 3—3 of FIG. 2 showing the interior portion of the subject improved paperboard traffic channeling device showing a weight being positioned on top of the inner cap like structure herein before described.
Figure 6:
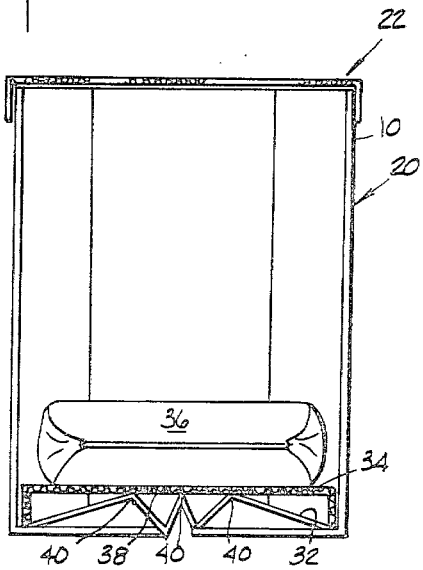
FIG. 6 is a cross sectional view, taken along line 6—6 of FIG. 2, showing the flap structure of the Applicants' invention and further showing the positioning of the inner cap like structure in relation to the inwardly folded flap structure and also the position of the weight on top of the inner cap like structure.

Referring now to FIGS. 3 and 4 of the drawing and in particular FIG. 4 for the present time, there is shown a cross sectional view, taken along line 4—4 of FIG. 2 showing the inwardly folded flap structure 32 which is utilized with the means for aiding the forming of the shell and for holding the vertical standing shell structure 20 in a predetermined position on the highway. The flap structure is formed from a plurality of triangular shaped panels, a portion of which are horizontally positioned on the road surface and a portion of which are positioned vertically inside the shell as shown by the numeral 33 in FIG. 4. The inwardly folded flap structure will be detailed more fully hereinafter in particular when referring to FIGS. 11 and 13 to the drawing. Positioned on top of the inwardly folded flap structure 32, as shown in FIGS. 3 and 6 of the drawing is a tightly fitting inner cap like structure 34 of corrugated paperboard upon which is positioned a weight 36 in the form of a 50 lb. bag of sand or other weights as may be required. The weight 36 is utilized to hold the vertical standing shell structure 20 in a predetermined position on the highway. The inner cap like structure 34 is utilized to aid in the forming of the shell structure in a predetermined shape such as an octagonal shape as shown in the preferred embodiment. The inner cap like structure 34 also functions to transfer the weight of weight 36 to the bottom flap structure.

By referring now to FIG. 6 of the drawing there is shown a cross sectional view, taken along line 6—6 of FIG. 2, showing the placement of the weight 36 on top of the inner cap like structure 34. It can be seen in FIG. 6 that the underside 38 of the inner cap like structure 34 is resting on the upwardly protruding points 40 of the flap structure 32. When the paperboard shell 20 is constructed in an octagonal shape as shown in the drawings, it can be seen by referring to FIG. 4 that eight points 40 are formed from the inwardly folded flap structure 32 to provide a planar surface on which to position the inner cap like structure 34 to provide a downwardly force on the flap structure. This downward force will aid in retaining the traffic channeling device 10 in an upright position on the highway 14. The inner cap like structure 34 is formed in an octagonal configuration and is sized to tightly fit the inside dimensions of the paper-board shell 20 when the shell is erected. When inserted into the shell structure, the inner cap like structure 34 then acts to aid in the forming of the shell and to hold the shell 20 into its intended octagonal shape. While a weighted bag is utilized as a weight 36 in the combination, other weights may be positioned within the device and on top of the inner cap like structure 34. Such other weights may comprise old automobile tires, loose sand or dirt, rocks or other available materials. The inner cap like structure 34 functionally acts as a table upon which the weight 36 rests. It can be seen that the distribution of weight on the table will be generally uniform on the outer edge of inwardly folded flap structure 32 along the scoreline 152 shown in FIG. 6 and through the folded flap structure. The construction of the inner cap like structure 34 will be detailed hereinafter when referring to FIGS. 14-17.

Figure 5:
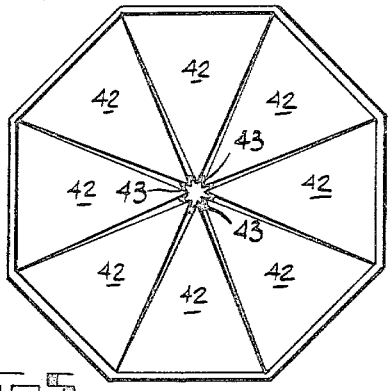
FIG. 5 is a bottom view, taken along line 5—5 showing the improved inwardly folded flap structure and showing the portion of the inwardly folded flap structure that is in contact with the highway surface.

Referring now to FIG. 5 of the drawing, there is shown a bottom view of the traffic channeling device 10, taken along line 5—5 of FIG. 2, showing the inwardly folded flap structure wherein a triangular shaped portion 42 of the flap structure is exposed to the exterior of the device and is in contact with the highway surface. Because of the manner of folding the bottom flaps, it can be seen that a minimal portion 43 of the edges of the flap structure will be in contact with standing water that may be on the road surface. This can be seen in FIG. 13 of the drawings which illustrates the traffic channeling device on its side and which shows the manner of folding the flap structure. Should it be desirable or necessary to ensure that the traffic channeling device 10 remains in a fixed position on the highway, then an adhesive may be applied to the portion 42 of the flaps that lie in contact with the highway surface. It can be seen in FIG. 5 that by the inwardly folding of the flap structure, the portions 42 of the flaps form a relatively flat octagonal shaped surface which is in contact with the highway surface. Thusly it can be seen that when the weight 36 is positioned on the inner cap like structure 34, as before mentioned and shown in the drawing FIG. 6, the downwardly bearing weight is distributed through the scoreline fold at 152 to the outer portion 42 of the flaps in contact with the highway and also to the upwardly protruding points 40 thereby providing a good load distributing bearing on the highway which acts to retain the traffic channeling device in an upright position. It can also be seen by referring to FIG. 4 that the vertical flap 33 has its edges 35 also vertically positioned which raises a major portion of the bottom flap structure above any free standing surface water thereby minimizing deterioration of the flap structure. By referring to FIG. 11 it can be seen how only the edge 43 of the flap structure is actually in contact with surfce water since the edges 35 are vertically positioned as before mentioned.

Figure 14:
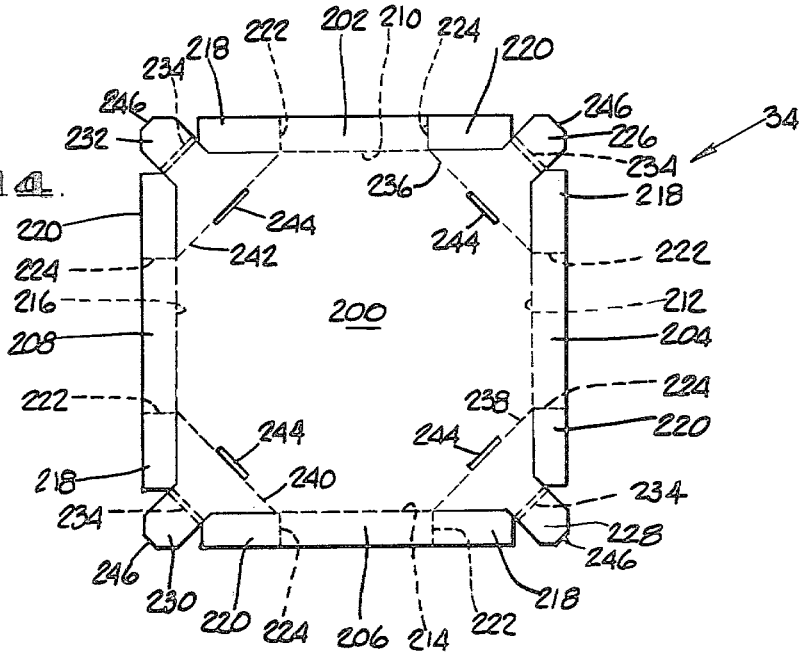
FIG. 14 is a plan view of the inner cap like structure of the subject invention.

Referring now to FIGS. 14–17, there is shown one embodiment of the inner cap like structure 34 which is shown in FIG. 14 in the flat production blank stage. The inner cap like structure 34 comprises a central panel 200 having a plurality of outer flaps 202, 204, 206, and 208. The outer flaps are hingedly attached to the central panel 200 by means of the score lines 210, 212, 214, and 216. Each outer flap has a pair of similar shorter flaps 218 and 220 hingedly attached thereto by means of the score lines 222 and 224.

The central panel 200 also has formed on the four corners thereof a plurality of elongated flaps 226, 228, 230, and 232. Each elongated flap also contains a double score line 234 located approximately in the mid-portion of the elongated flap. Each elongated flap also is hingedly attached to the central panel 200 by means of its score line 236, 238, 240, or 242. These score lines also contain an elongated cut out 244 which is sized to fit the tapered end 246 at the outer edge of the elongated flaps.

Figure 15:
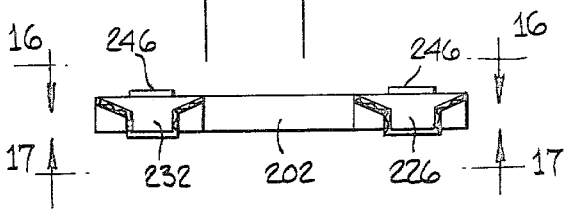
FIG. 15 is a side view of the inner cap like structure shown in FIG. 14 showing the inner cap like structure assembled and prior to being inserted into the shell.
Figure 16:
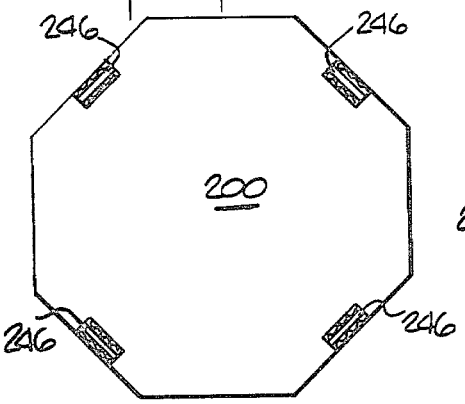
FIG. 16 is a top view, taken along line 16—16 of the inner cap like structure in FIG. 15.

Referring now to FIG. 15 of the drawing, there is shown a side view of the inner cap like structure 34 shown in FIG. 14 showing the structure assembled. It can be seen in FIG. 15 as well as in FIGS. 16 and 17 how the elongated flaps 226, 228, 230 and 232 are folded about their respective score lines 236, 238, 240 and 242 and also about their double score lines 234 so that their tapered ends 246 may be inserted within the cut-out 244.

Figure 17:
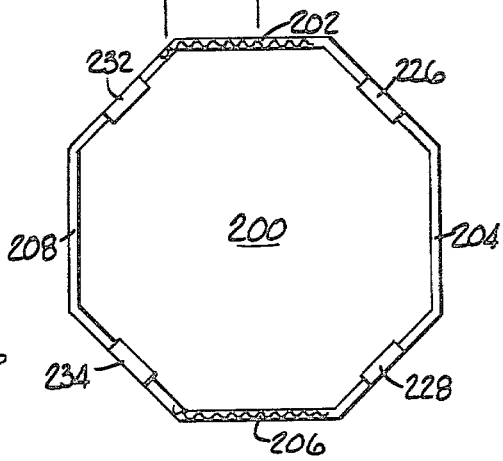
FIG. 17 is a bottom view, taken along line 17—17 of the inner cap like structure in FIG. 15.

It will be noted that the folding of the inner cap like structure 34 is similar to the folding of the outer top cap to be described in more detail hereinafter and as shown in FIG. 7 of the drawing and reference can be made to that description and FIG. 17 to see how the respective shorter flaps 218 and 220 are folded underneath the elongated flaps 226, 228, 230 and 232. The folding of the inner cap like structure 34 as well as the outer top cap 22 is known in the art and provides a rigid cap like strucutre whenever folded in the manner shown. This structure 34 may be formed of corrugated paperboard or other materials within the spirit and scope of the invention and may also be coated on one or both sides with wax or other materials to make it water resistant.

Referring now back to FIGS. 7–10 there is shown one embodiment of an outer top cap which may be utilized with the subject invention whenever the traffic channeling device is formed in a generally octagonal shaped configuration. The outer top cap 22 shown in FIG. 7 comprises a central panel 44 having attached thereto four side panels 46, 48, 50 and 52 by means of the score lines 54, 56, 58 and 60. The side panels 46, 48, 50 and 52 also have formed therein a pair of double score lines 62 and 64 midway within the panel as shown in FIG. 7. Formed on the outside of each side panel 46, 48, 50 and 52 is a tab 66 which is designed 25 to be received within a recessed indented mating slot 68 whenever the side panel is folded along the score lines 62 and 64. The indented slot 68 is not cut all the way through the outside liner of the outer top cap 22.

The central panel 44 also has formed on four sides thereof a somewhat shorter side panel 70, 72, 74 and 76 which is hingedly attached to the central panel 44 by means of the score lines 78, 80, 82 and 84. The shorter side panels 70, 72, 74 and 76 also have placed therein a series of score lines 86, 88, 90, 92, 94, 96, 98 and 100 forming a series of triangular shaped portions 102, 104, 106, 108, 110, 112, 114 and 116.

In erecting the outer top cap 22 to the position shown in FIGS. 8–10 of the drawing, the shorter side panels 70, 72, 74 and 76 are folded about their respective score lines 78, 80, 82 and 84 at an angle of 90° to the face of the central panel 44. Thereafter the longer side panels 46, 48, 50 and 52 are folded about their respective score lines 54, 56, 58 and 60 to a position 90° from the face of the central panel 44. The next step in the erection of the outer top cap 22 is to fold the triangular shaped portions 102, 104, 106, 108, 110, 112, 114 and 116 about their respective score lines 86, 88, 90, 92, 94, 96, 98 and 100 so that the triangular shaped portions are positoned between the two pieces of the respective longer side panels 46, 48, 50 and 52 as they are folded about their respective score lines 62 and 64 with the tabs 66 beings inserted into the slots 68 to hold the entire top cap in the position shown in FIGS. 8–10 of the drawings.

When folded in this manner the outer top cap 22 then becomes octagonal in shape and may be tightly positioned on top of the octagonal shell structure 20 as shown in FIG. 2 of the drawing should it be desired to utilize an outer top cap with the traffic channeling device. The outer top cap 22 would be made moisture proof by curtain coating or wax impregnating or other means on one or both sides and may also have the exposed flutes blocked by means of filling with wax or other materials.

Turning now to FIG. 11 of the drawing there is shown a plan view of the production blank of the subject paperboard shell 20 which comprises a plurality of panels 118, 120, 122, 124, 126, 128, 130 and 132 which are hingedly attached to each other by means of the score lines 134, 136, 138, 140, 142, 144 and 146. The panel 118 also has hingedly attached thereto, by means of the score line 148 a manufacturers joint flap 150. As before mentioned, the paperboard shell has applied thereto a plurality of orange strips 28 and a plurality of white strips 30 in the sequence as desired by the customer. The paperboard shell may also be formed of corrugated paperboard in the preferred embodiment and would be constructed in a moisture proof manner by curtain coating the corrugated paperboard or wax impregnating it as desired by the customer.

Formed on one end of the production blank for the paperboard shell 20 would be a flap structure formed with a plurality of triangular shaped flap portons 42 as before mentioned which are hingedly attached to thier respective panels by means of an elongated score line 152. The flap portions 42 are formed in a triangular shape by means of a pair of score lines 154 and 156 which originate at the elongated score line 152 and terminate at the edge 158 of the paperboard shell 20.

Referring now to FIG. 12 of the drawing there is shown a cross sectional view, taken along line 12—12 of FIG. 11 showing the construction of the rolled edge of the paperboard shell which is formed at least on one edge of the shell. It can be seen in FIG. 12 that in the embodiment shown the paperboard shell 20 would be formed of double wall corrugated having two layers of corrugation 160 and 162 separated by a paperboard sheet 164 which is in turn lined on the top and bottom by a paperboard sheet 166 and 168. It can be seen that the sheet 168 is formed somewhat longer than the sheet 166 and is overlapped onto the sheet 166 to form the paper edge 170 and 172. When formed thusly the exposed flutes of the corrugated structure would be protected by the overlapped paper edges 170 and 172 thereby further minimizing disintegration of the paperboard resulting from exterior moisture. This structure is known in the art as a rolled edge and this edge may be applied on one end or both ends of the traffic channeling device as desired by the customer. When applied thusly the rolled edge in combination with the moisture proof application to the paperboard shell and the use of triangular shaped flap results in a moisture resistant structure which may be exposed to the weather for long periods of time without deteriorating since exposure of the flute edges to standing water is minimized. In addition the manufacturers flap 150 as well as the panel 132 may have their respective edges 174 and 176 blocked or closed by wax or some other material. It may also be desirable to block the edge 178 and 180 on the upper and lower ends of the paper-board traffic channeling device prior to rolling edges as shown in FIG. 12 of the drawing.

Figure 13:
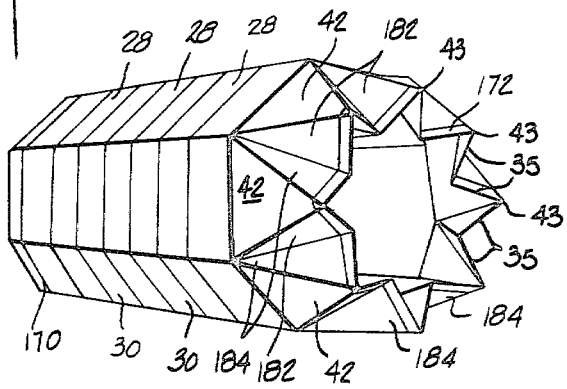
FIG. 13 is a perspective view of the Applicants' new and improved traffic channeling device showing the bottom structure of the preferred embodiment partially folded and prior to being positioned as shown in FIG. 5 of the drawing.

Referring now to FIG. 13 there is shown a perspective of the Applicants' traffic channeling device showing it lying on its side and after the production blank has been erected and prior to completely folding the flap structure of the device inwardly. As before mentioned the flap structure when formed as shown in FIG. 11 of the drawing utilizes a portion of flaps 42 on the outside of the structure and also utilizes a portion of flaps 182 and 184 which are folded against each other as shown in FIG. 4 of the drawing and are positioned vertically inside the structure of the shell. When forming the flap structure as shown in FIG. 13 of the drawing each pair of flaps 182 and 184 would be folded about their respective score lines to the position shown where upon the flap structure would be ultimately folded as shown in FIG. 5 of the drawing by applying pressure on the folded flaps to form the pie-shaped portion of flaps 42 seen in FIG. 5. It can be seen in FIG. 13 that the rolled edges 170 and 172 on the upper and lower portion of the paperboard shell then act to prevent moisture from entering into the exposed flute edges of the shell and the vertical positioning of the flap edges 172 raises the edges from contact with surface water. The inner cap like structure 34 which would have previously been folded is then placed inside the shell to aid in forming and holding the predetermined shape of the shell as well as to carry the weight 36 as shown in FIG. 6.

When the traffic channeling device of the subject invention is constructed of paperboard, either corrugated or kraft paper uncorrugated or solid fiber, it may also be highly desirable to coat and/or impregnate the entire paper surface both inside and outside with a weather resistant coating such as a wax coating or a plastic coating of some type. It is within the spirit and scope of the invention that it may also be coated or impregnated with other types of weather resistant coatings known in the market place to be satisfactory for the purpose of coating paperboard.

From the above, it can be seen that the subject new and improved traffic channeling device overcomes the difficulties encountered with the before mentioned devices. The subject improved channeling device may be quickly erected at the job site using the inner cap like structure 34 to aid in forming and holding the shape of the shell and the entire device may be discarded by burning or disposed in other manners whenever the construction is complete. It may also be broken down and stored flat for later reuse thereby reducing the storage space necessary for a large inventory of traffic channeling devices. When the subject new and improved channeling device is struck by a passing car or truck as often happens, the device will not become a dangerous projectile which could injure the adjacent construction workers but will simply break apart into a harmless pile leaving the sand bag or other weight positioned inside in a harmless pile on the road. The flap structure for the bottom aids in preventing deterioration of the flap structure by raising a major portion of the flute edges from surface water contact. By the use of rolled edges on the flute edge, further surface water penetration is controlled thereby resulting in longer life of the applicants device. The use of the inner cap like structure 34 aids in the formation of the shell and also acts to distribute the weight placed on top thereof thereby adding stability to the device whenever it is positioned on a highway.

It can be seen that there has been provided by the subject invention an improved traffic channeling device that accomplishes all of the objects and advantages of the invention and many others. It should also be noted that many changes can be made in the structure as shown and in the arrangement of the various parts of the device without departing from the spirit and scope of the invention and the subject invention is not to be limited to the embodiment shown which was given by way of illustration only.

Having described my invention, I claim:

1. An improved traffic channeling device for positioning on a highway in the normal traffic flow pattern, comprising, in combination:

(a) a moisture-proof paperboard shell structure including a body having a substantially uniform cross-section and an open end, and having formed on the other end thereof a horizontal inwardly folded flap structure having formed thereon means for preventing moisture from entering into the flap structure, the flap structure being formed by a plurality of triangularly shaped panels hingedly attached together and a vertical upwardly folded flap structure remaining portion formed by a plurality of triangularly shaped panels, said shell structure being designed for standing on the highway in a vertical position with said open end upward so that the horizontal portion of the inwardly folded flap structure is in contact with the highway surface and the vertical remaining portion of the upwardly folded flap structure is out of contact with the highway surface;

(b) separate means, associated with the upwardly folded remaining portion flap structure and positioned internally and within the lower portion of the shell structure on top of the inwardly folded flap structure and in contact therewith around the lower inner periphery of the shell structure as well as around the central portion of the flap structure, for aiding the forming of the vertical standing shell structure in a predetermined shape, the aiding means also serving as a means to support an object positioned over the flap structure to hold the shell structure in a predetermined position on the highway, the support being given around the inner periphery of the shell structure as well as in the central portion of the flap structure through the vertical upwardly folded flap structure remaining portions; and (c) means, associated with the outside of the vertical standing shell structure, for warning the traffic flow that the device has been positioned on the highway in the normal traffic flow.

2. The device as defined in claim 1 wherein the warning means comprises an adhesive reflecting tape applied to at least a portion of the outside of the shell structure.

3. The device as defined in claim 1 wherein the warning means comprises a reflective coating applied to at least a portion of the outside of the shell.

4. The device as defined in claim 1 wherein the aiding means comprises an inner cap like structure being positioned downwardly and over and in contact with the inwardly folded flap structure remaining portions in the central portion of the flap structure and in contact with the lower inner periphery of the shell structure.

5. The device as defined in claim 1 further comprising an outer top cap being positioned on top of the vertical standing shell structure to cover the one open end.

6. The device as defined in claim 1 wherein the shell structure is octagonal in shape.

7. The device as defined in claim 6 further comprising an outer top cap being positioned on top of the vertical standing shell structure to cover the one open end.

8. The device as defined in claim 1 wherein the paperboard shell structure has formed thereon, on at least one of its edges, a rolled edge for preventing moisture from entering into the center portion of the paperboard.

9. The device as defined in claim 1 wherein the paperboard shell structure has formed thereon rolled edges on opposite ends of the structure for preventing moisture from entering into the center portion of the paperboard from either edge.

10. The device as defined in claim 1 wherein the paperboard shell structure is formed from corrugated paperboard.

* * * * *